US006232999B1

(12) United States Patent
Kerr et al.

(10) Patent No.: US 6,232,999 B1
(45) Date of Patent: May 15, 2001

(54) METHOD FOR CHANGING FOCUS AND ANGLE OF A MULTICHANNEL PRINTHEAD

(75) Inventors: Roger S. Kerr, Brockport; Kurt M. Sanger; Robert W. Spurr, both of Rochester; David F. Dalfonso, Victor, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/344,917

(22) Filed: Jun. 25, 1999

(51) Int. Cl.[7] ..... B41J 15/14
(52) U.S. Cl. ..... 347/241; 356/123
(58) Field of Search ..... 347/241, 245, 347/263; 346/139 R, 139 D; 358/474, 504; 356/123, 400; 250/548, 201.2; 359/383, 384

(56) References Cited

U.S. PATENT DOCUMENTS

| | | | | |
|---|---|---|---|---|
| 4,127,777 | * | 11/1978 | Binder | 250/458 |
| 4,264,220 | | 4/1981 | Okeuoglu | 400/144.2 |
| 4,394,696 | | 7/1983 | Yoshimaru | 360/78.02 |
| 4,395,742 | | 7/1983 | Ostroff | 360/78.13 |
| 4,408,907 | | 10/1983 | Bernardis | 400/124.11 |
| 4,893,926 | * | 1/1990 | Willis | 356/123 |
| 5,047,796 | | 9/1991 | Tagami et al. | 396/132 |
| 5,083,143 | | 1/1992 | Hoffman | 346/139 R |
| 5,146,242 | | 9/1992 | Zielinski | 220/495.02 |
| 5,164,742 | | 11/1992 | Baek et al. | 347/234 |
| 5,268,708 | | 12/1993 | Harshbarger et al. | 346/134 |
| 5,453,777 | | 9/1995 | Pensavecchia et al. | 347/234 |
| 5,491,595 | | 2/1996 | Alsborg et al. | 360/75 |
| 5,767,989 | * | 6/1998 | Sakaguchi | 358/474 |
| 5,997,119 | * | 12/1999 | Kerr | 346/139 R |

* cited by examiner

*Primary Examiner*—N. Le
*Assistant Examiner*—Hai C. Pham
(74) *Attorney, Agent, or Firm*—Nelson Adrian Blish

(57) ABSTRACT

The present invention is for a method for adjusting a focus of a multichannel printhead (500) for an imaging processing apparatus (10) performing the steps of establishing a home focus position and moving the printhead (500) in a first direction a predetermined number of coarse density. The printhead (500) is moved to the coarse focus position and then moved in a second direction a predetermined number of fine steps. A series of second test patches is printed on the media (32) at each of the fine steps. A fine focus position is determined by checking a fine density of each of the second test patches and selecting the fine focus position corresponding to the second test patch having a highest fine density.

12 Claims, 10 Drawing Sheets

METHOD FOR CHANGING FOCUS AND ANGLE OF A MULTICHANNEL PRINTHEAD

CROSS REFERENCE TO RELATED APPLICATIONS

The following commonly assigned patent applications are relevant to this application.

Ser. No. 08/861,119, filed May 21, 1997, titled An Image Processor Having Magnetically Attached Printhead, now U.S. Pat. No. 6,034,713.

Ser. No. 09/143,002 filed Aug. 28, 1998, titled A Magnetic Arrangement For Printhead Positioning In An Image Processing Apparatus, now U.S. Pat. No. 5,997,119.

Ser. No. 09/143,007, filed Aug. 28, 1998 titled Method And Apparatus To Provide A Loading Force For Printhead Adjustment Using Magnets, now U.S. Pat. No. 6,100,911.

FIELD OF THE INVENTION

This invention relates to the control of printhead focus and printhead angle in an image processing apparatus of the lathe bed scanning type.

BACKGROUND OF THE INVENTION

Pre-press color proofing is a procedure that is used by the printing industry for creating representative images of printed material without the high cost and time that is required to actually produce printing plates and set up a high-speed, high-volume, printing press to produce a single example of an intended image. These intended images may require several corrections and may need to be reproduced several times to satisfy customers requirements resulting in a large loss of profits. By utilizing pre-press color proofing time and money can be saved.

One such commercially available image processing apparatus, which is depicted in commonly assigned U.S. Pat. No. 5,268,708, is an image processing apparatus having half-tone color proofing capabilities. This image processing apparatus is arranged to form an intended image on a sheet of thermal print media by transferring dye from a sheet of dye donor material to the thermal print media by applying thermal energy to the dye donor material, to transfer dye to the thermal print media, thereby forming an intended image. This image processing apparatus is comprised generally of a material supply assembly or carousel, lathe bed scanning subsystem (which includes a lathe bed scanning frame, translation drive, translation stage member, print-head, and vacuum imaging drum), and thermal print media and dye donor material exit transports.

The operation of the image processing apparatus comprises metering a length of the thermal print media, in roll form, from the material assembly or carousel. The thermal print media is measured and cut into sheet form of the required length and transported to the vacuum imaging drum, registered, wrapped around and secured onto the vacuum imaging drum. A length of dye donor material, in roll form, is metered out of the material supply assembly or carousel, measured and cut into sheet form of the required length. The dye donor material is transported to and wrapped around the vacuum imaging drum, such that it is superposed in registration with the thermal print media. The translation drive, part of the scanning subsystem, traverses the printhead and translation stage member axially along the vacuum imaging drum in coordinated motion with the rotating vacuum imaging drum to produce the intended image on the thermal print media The printhead includes a plurality of laser diodes which are coupled to the printhead by fiber optic cables which can be individually modulated to supply energy to selected areas of the thermal print media in accordance with an information signal. The printhead includes a plurality of optical fibers coupled to the laser diodes at one end and at the other end to a fiber optic array within the printhead. The printhead moves relative to the longitudinal axis of the vacuum imaging drum and dye is transferred to the thermal print media as the radiation, transferred from the laser diodes by the optical fibers to the printhead to the dye donor material, is converted to thermal energy in the dye donor material.

Although the image processing apparatus described is satisfactory, it is not without drawbacks. Obtaining the correct printhead focus requires an iterative sequence of precise manual adjustments using a micrometer and generation of focus prints that provide feedback information on focus accuracy. Measurements from the test print are used to determine whether or not further adjustment is necessary. For this reason, printhead focus requires trained service personnel to calibrate printhead components and make repeated manual adjustments. This limits the ability of the image processing apparatus user to adapt the machine to media having different thickness or to media having different spot focus requirements. Similarly, the angle of the printhead about its axis, which determines the distance between imaged dots, described in U.S. Pat. No. 5,164,742 (Back, et al.), also requires precise manual adjustment, with a series of test prints for feedback, and one or more manual readjustment cycles. It would be advantageous to automated control of these adjustments.

Conventional servo loops are one way to solve the problem. For example, stepper motors are widely used in optical equipment to focus lens assemblies automatically and a number of commercially available "point-and-shoot" SLR cameras employ stepper motors to obtain correct focus. U.S. Pat. No. 5,047,796 (Tagami et al.) discloses a stepper motor for obtaining camera focus. However, servo loops using stepper motors are prohibitively expensive and impractical for controlling head focus or angular positioning.

Stepper motors are inherently well suited to applications that require precision positioning. The construction of the stepper motor provides a set of discrete, fixed positions, shaft based on a symmetric arrangement of rotor poles and stator windings. U.S. Pat. No. 5,453,777 (Pennsavecchia et al.) discloses multiple stepper motors for adjusting focus in a laser imagesetter apparatus. Focus is adjusted individually for each channel, each of which writes with a single laser focused through its own lens assembly. The device, however, generates a swath in multiple passes, unlike the continuous-swath generated by the image processing apparatus of the present invention.

Methods for homing or registration using a stepper motor employ phase state relationship of currents in combination with a microswitch or other sensor that indicates proximity of the driven device to a home position. U.S. Pat. No. 4,394,696 (Yoshimaru) uses control logic for positioning a magnetic read-write head in a tape drive and uses a microswitch transition to indicate that the head is in the neighborhood of its home position. When a control circuit senses this transition, the phase state relationship of currents is used to move the read-write head to home.

In much the same way, U.S. Pat. No. 5,491,595 (Alsborg, et al.) discloses a positioning method for a magnetic read-write head using a proximity sensor and a control algorithm that provides positioning using a coarse-fine sequence. First, control logic drives the stepper motor a number of steps (N) at a time in a first direction, while checking the proximity sensor for a transition indicating coarse position. Control logic then drives the stepper motor a number of smaller steps in the opposite direction, past the transition point. Next, control logic drives the stepper motor, again in the first direction, a number of still smaller steps (M<N) at a time, until the sensor transition recurs, indicating that fine-tuning has been obtained.

U.S. Pat. No. 4,264,220 (Okcuoglu et al.) discloses running a stepper motor to home a print wheel, where a stop position on the print wheel may initially be in any angular position relative to a corresponding fixed stop element. In order to compensate for possible worst-case print wheel positioning, where the print wheel must rotate over its full angular travel path in order to reach home position, the stepper motor rotates the print wheel the maximum possible number of steps to make sure that the print wheel stops in the fixed stop position. This often means running the motor blocked for at least some number of steps, which is satisfactory for many types of stepper motors. On less expensive motors, the internal mechanical configuration of stepper motor components may not withstand running with the rotor blocked for extended periods. Notably, some types of stepper motors widely used for linear positioning have plastic internal components where, for example, a plastic rotor rotates about a metal lead screw. Running such a motor with blocked rotor can cause damage to plastic threads and ruin the motor. This limits the use of such motors when used with mechanical stops for homing applications.

U.S. Pat. No. 4,395,742 (Ostroff) discloses a method for homing a magnetic read-write head in a disk drive that uses, in combination, a mechanical stop and the phase relationship described above. By stopping head movement mechanically, then using a known current phase relationship, or "program," a method is disclosed for accurate homing of the magnetic read-write head upon power-up. During normal seek operation, the stepper motor is driven at higher current levels. To prevent mechanical damage due to running with the rotor blocked, the motor is run with reduced current and therefore with reduced torque for homing the magnetic read-write head. This solution is acceptable for applications that allow movement with low motor torque, such as positioning a light-weight read-write head, however, it is not adequate for focusing or angular positioning for a scanning printhead, since this movement requires the full torque available from the stepper motor. Further disadvantages of this approach include the added complexity and cost of circuitry for setting the alternate current level.

U.S. Pat. No. 4,408,907 (Bernardis) discloses use of a stepper motor to adjust the angle of a printhead in a dot-matrix printer. The apparatus disclosed sets the printhead angle to one of two possible positions, however, there is no capability provided for any fine-tuning of printing head angle and the stepper motor is used merely to toggle the printing head to either of two angle settings.

Accurately setting the swath width for a multichannel printer requires mechanical adjustment within tight tolerances (see U.S. Pat. No. 5,083,143 (Hoffman) which describes swath width adjustment in an inkjet printer.) Repeated cycles of manual adjustment and generation of a test print can make printhead angle adjustment a time-consuming and costly procedure. For a printhead requiring high resolution, this adjustment typically requires use of a microscope, micrometer, or other sensitive instrumentation. For example, U.S. Pat. No. 5,146,242 (Zielinski) describes a method for manual adjustment of a printhead angle in a multichannel apparatus using micrometer screw adjustment. Without automatic adjustment of the head angle in an image processing apparatus, the apparatus is limited to imaging at one specific resolution once head angle adjustment is obtained.

There is a need for a method to automatically adjust printhead angle or focus or both as the test print is generated.

SUMMARY OF THE INVENTION

Briefly summarized, according to one aspect of the present invention, a method for adjusting a focus of a multichannel printhead for an imaging processing apparatus is disclosed comprising the steps of establishing a home focus position and moving said printhead in a first direction a predetermined number of coarse steps. A series of first test patches is printed on a media at each of the coarse steps and a course focus position is determined by checking a coarse density of each of the first test patches and selecting the course focus position corresponding to the first test patch having a highest coarse density. The printhead is moved to the course focus position and then moved in a second direction a predetermined number of fine steps. A series of second test patches is printed on the media at each of the fine steps. A fine focus position is determined by checking a fine density of each of the second test patches and selecting the fine focus position corresponding to the second test patch having a highest fine density. In a further embodiment of the invention an optimum angle of the printhead is determined by establishing a home angular position. The printhead is moved in a first rotational direction a predetermined number of coarse rotational steps and a series of third test patches is printed on the media at each of the course rotational steps. A course angular position is determined by checking a course rotational density of each of the third test patches and selecting the course angular position corresponding to a third test patch having a highest coarse rotational density. The printhead is moved to the course angular position, then moved in a second rotational direction a predetermined number of fine rotational steps. A series of fourth test patches is printed on said media at each of said fine rotational steps. A fine focus angular position is determined by checking a fine rotational density of each of the fourth test patches and selecting the fine angular position corresponding to the fourth test patch having a highest fine rotational density.

An advantage of the present invention is that it provides an automated method for determining printhead focus and printhead angle in an image processing apparatus.

It is a further advantage of the present invention that it allows head focus and angular adjustment under the control of machine software commands, minimizing the need for manual mechanical adjustments for printhead positioning.

Yet another advantage is that the present invention allows focus positions to be stored in memory and subsequently used for imaging media having different thickness or requiring different focus settings.

An additional advantage of the present invention is that the printhead can be adjusted to write an image at a plurality of resolution settings, since the optimal printhead angle adjustment for each resolution setting can be stored for subsequent recall by control logic.

It is a further advantage of the present invention that it allows the optimum focus position to be determined in an automated fashion, when used in an image processing apparatus that has a built-in densitometer.

Figure 6:
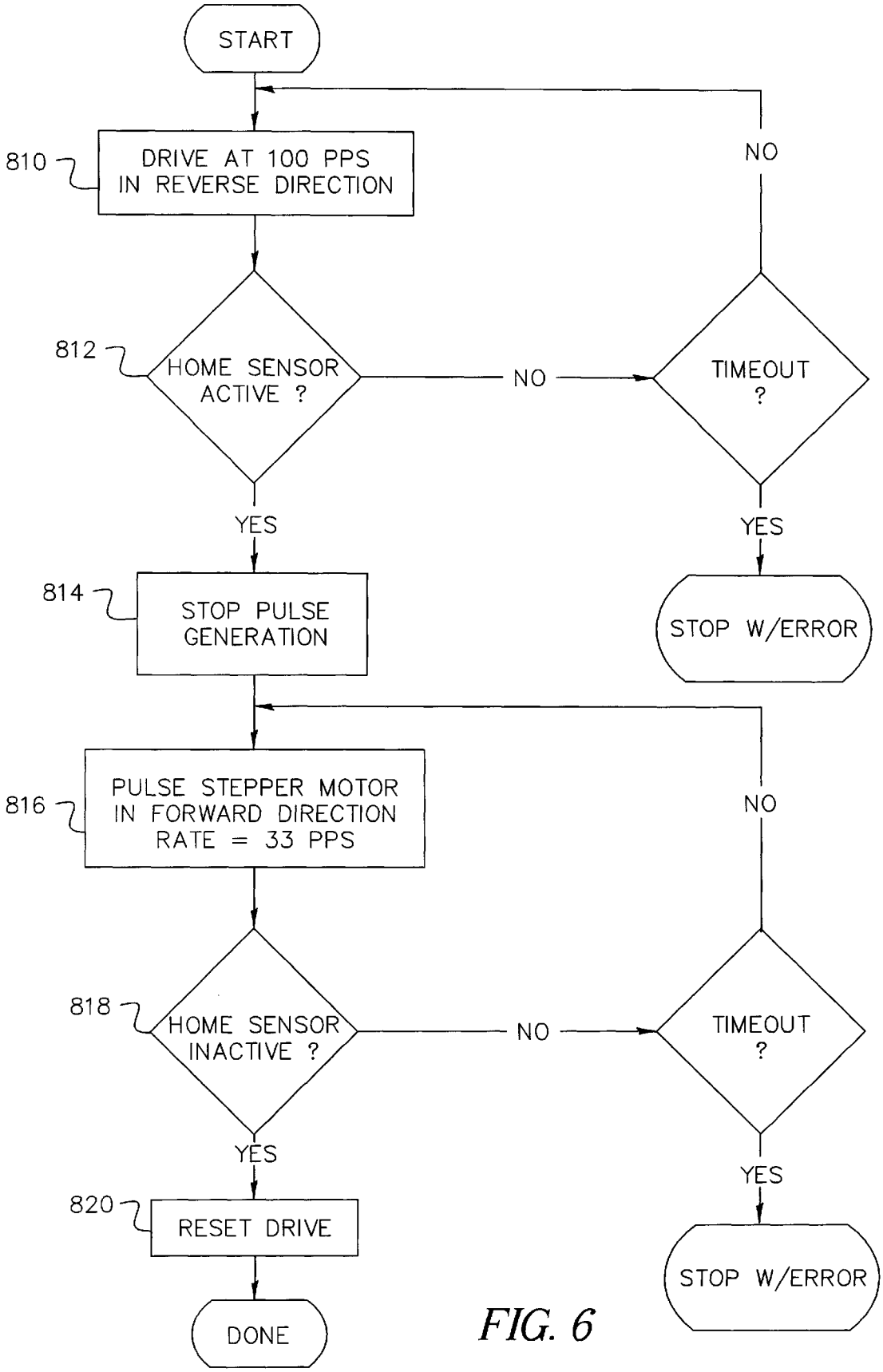

The flow chart of FIG. 6 traces the machine logic for detecting a home position, applied for both focus homing and head angle homing.

Figure 7A:
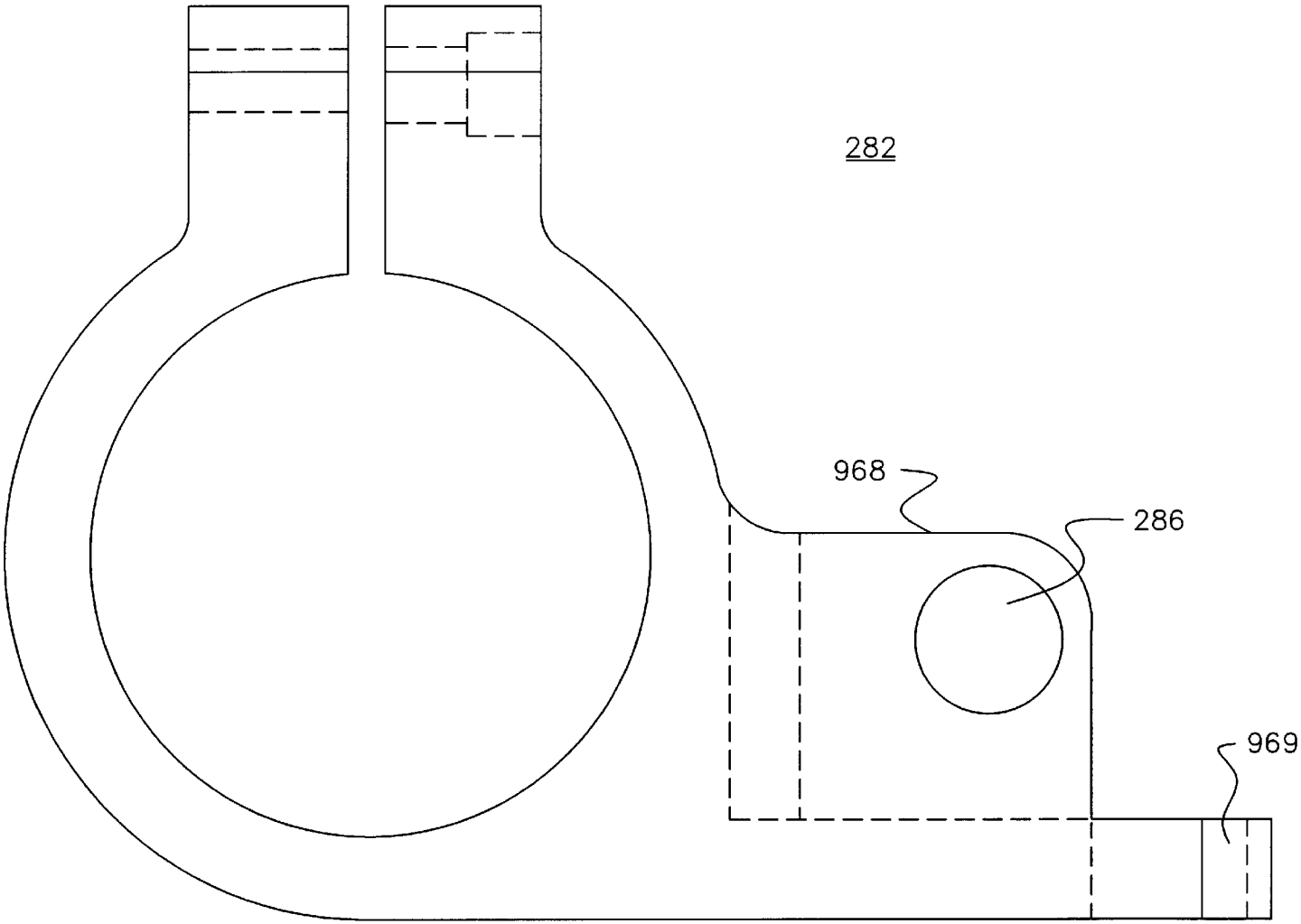
Figure 7B:
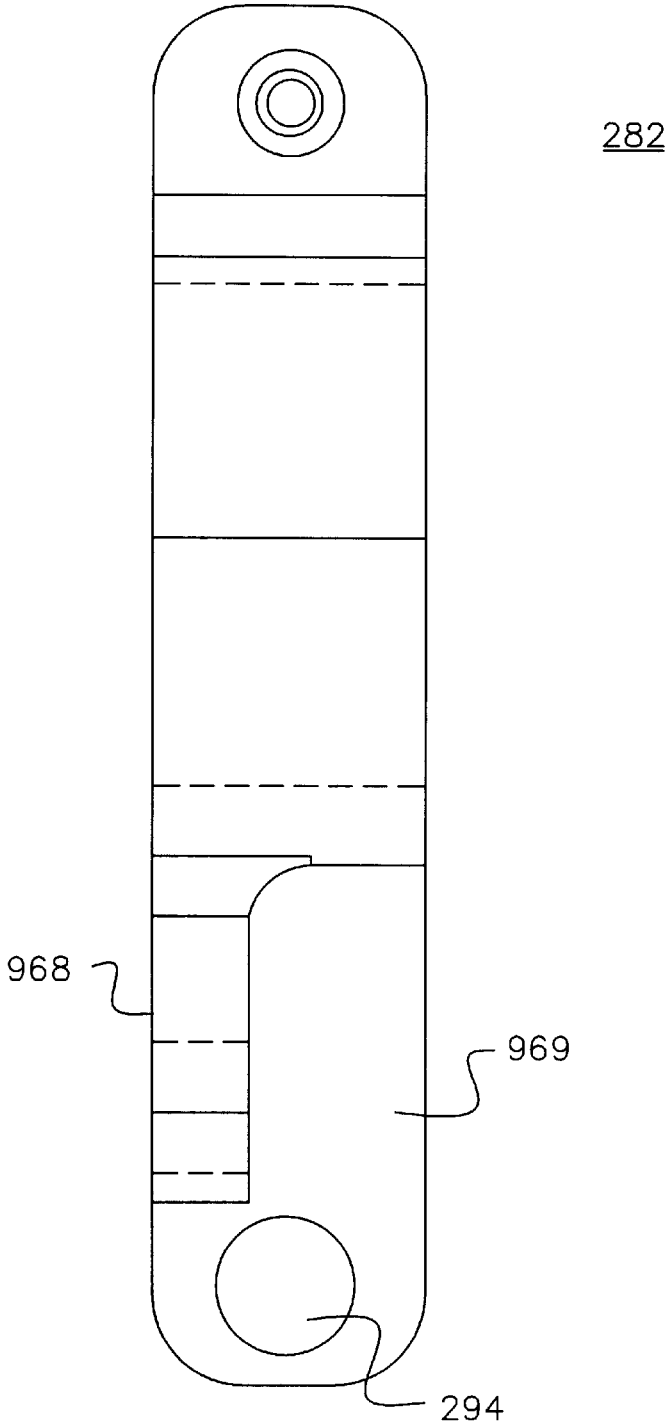

FIGS. 7*a* and 7*b* show front and top views of, respectively, the adjustment collar into which the printhead is fitted for both focus and angular positioning.

Figure 8:
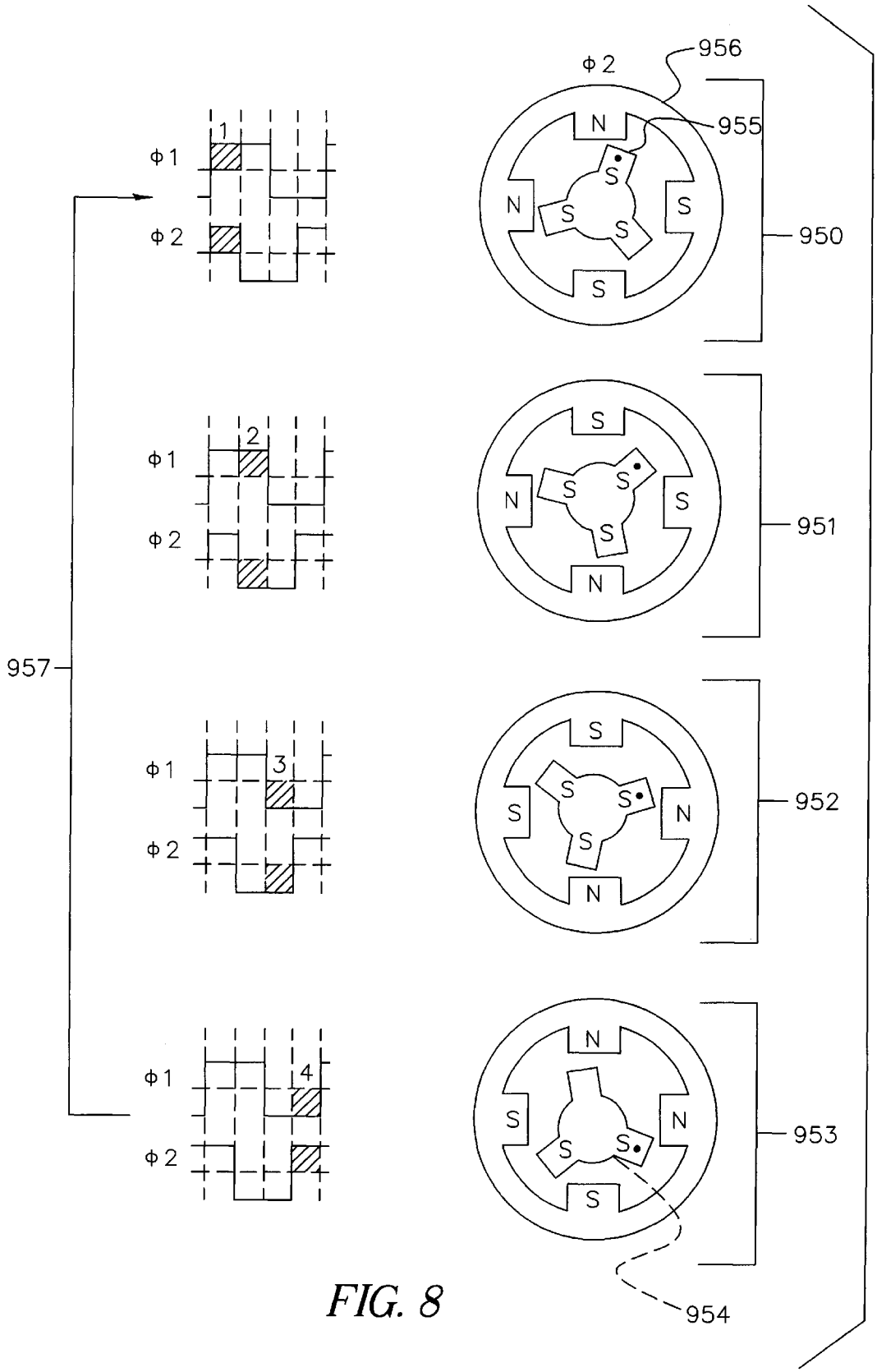

FIG. 8 illustrates, for an alternative embodiment, the relationship of stepper motor phase currents and rotor position to describe motor behavior once the mechanical stop is reached.

Figure 9:
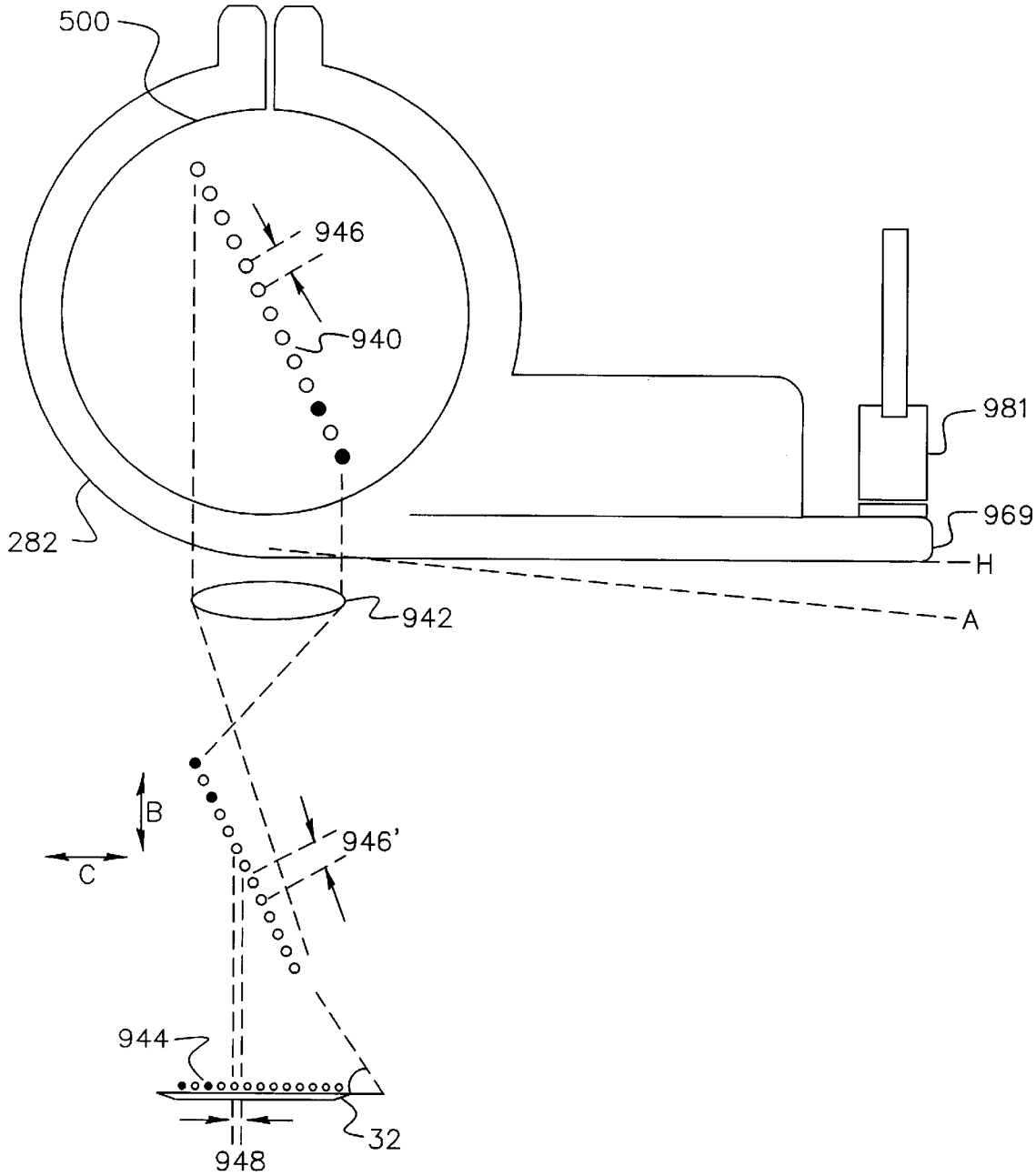

FIG. 9 shows, in schematic form, how the adjustment collar allows adjustment of printhead angle and how this adjustment changes the pixel-to-pixel distance on the receiver media surface.

DETAILED DESCRIPTION OF THE INVENTION

Figure 1:
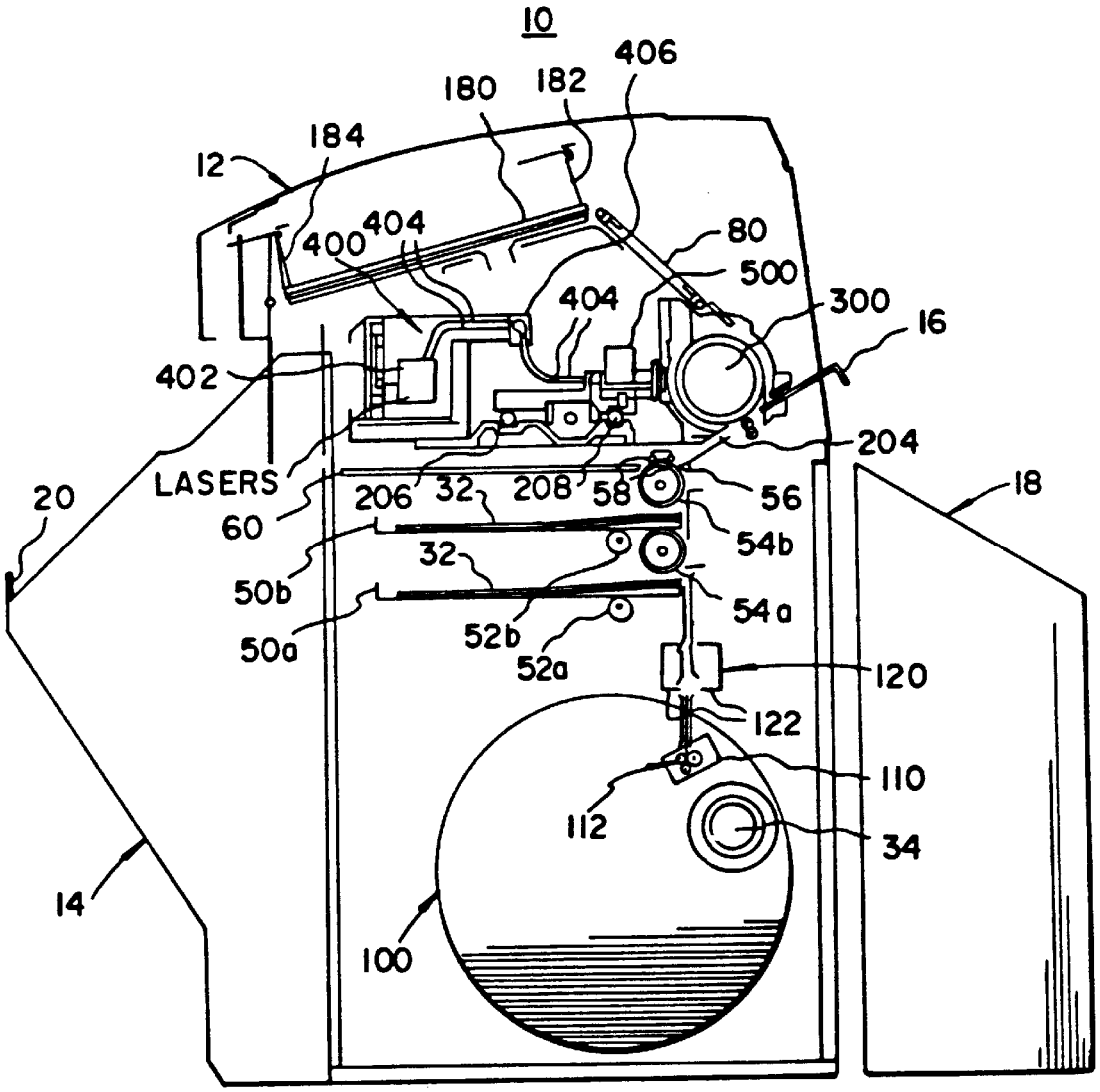
FIG. 1 is a side view in vertical cross section of an image processing apparatus of the present invention.

Referring to FIG. 1, there is illustrated an image processing apparatus according to the present invention having an image processor housing 12 which provides a protective cover. A movable, hinged image processor door 14 is attached to the front portion of image processor housing 12 permitting access to two sheet material trays, a lower sheet material tray 50*a* and an upper sheet material tray 50*b*, that are positioned in the interior portion of image processor housing 12 for supporting thermal print media 32, thereon. Only one of sheet material trays will dispense the thermal print media 32 to create an intended image thereon; the alternate sheet material tray either holds an alternative type of thermal print media 32 or functions as a back up sheet material tray. In this regard, lower sheet material tray 50*a* includes a lower media lift cam 52*a* for lifting lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. Upper sheet material tray 50*b* includes an upper media lift cam 52*b* for lifting upper sheet material tray 50*b* and ultimately the thermal print media 32 towards upper media roller 54*b* which directs it towards media guide 56.

Movable media guide 56 directs the thermal print media 32 under a pair of media guide rollers 58 which engages the thermal print media 32 for assisting upper media roller 54*b* in directing it onto media staging tray 60. Media guide 56 is attached and hinged to lathe bed scanning frame 202, shown in FIG. 2, at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving the thermal print media 32 resting on media staging tray 60 under the pair of media guide rollers 58, upwardly through an entrance passageway 204 and around rotatable vacuum imaging drum 300.

A roll of donor roll material 34 is connected to a media carousel 100 in a lower portion of image processor housing 12. Four rolls of roll media are used, but only one is shown for clarity. Each roll of donor material 34 is a different color, typically black, yellow, magenta and cyan. These donor roll materials 34 are ultimately cut into donor sheet materials 36 and passed to vacuum imaging drum 300 for forming the medium from which colorant imbedded therein are passed to thermal print media 32 resting thereon, which process is described in detail below. In this regard, a media drive mechanism 110 is attached to each roll media 30 of donor roll material 34, and includes three media drive rollers 112 through which the donor roll material 34 of interest is metered upwardly into a media knife assembly 120. After donor roll material 34 reaches a predetermined position, media drive rollers 112 cease driving the donor roll material 34 and two media knife blades 122 positioned at the bottom portion of media knife assembly 120 cut the donor roll material 34 into donor sheet materials 36 (not shown). Lower media roller 54*a* and upper media roller 54*b* along with media guide 56 then pass the donor sheet material 36 onto media staging tray 60 and ultimately to vacuum imaging drum 300 and in registration with the thermal print media 32 using the same process as described above for passing the thermal print media 32 onto vacuum imaging drum 300. The donor sheet material 36 now rests atop the thermal print media 32 with a narrow space between the two created by microbeads embedded in the surface of the thermal print media 32.

A laser assembly 400 includes a quantity of laser diodes 402 in its interior. Laser diodes 402 are connected via fiber optic cables 404 to a distribution block 406 and ultimately to printhead 500. Printhead 500 directs thermal energy received from laser diodes 402 causing the donor sheet material 36 to pass the desired colorant across the gap and onto the thermal print media 32.

In operation, vacuum imaging drum 300 rotates at a constant velocity. Printhead 500 begins at one end of the thermal print media 32 and traverses the length of the thermal print media 32, transferring data for a particular donor sheet material 36 resting on the thermal print media 32. After printhead 500 has completed the transfer process, for the donor sheet material 36 resting on the thermal print media 32 the donor sheet material 36 is then removed from the vacuum imaging drum 300 and transferred out of image processor housing 12 via a skive or donor ejection chute 16. The donor sheet material 36 eventually comes to rest in a donor waste bin 18 for removal by the user. The process is then repeated for the other three rolls of roll media 30 of donor roll materials 34.

After the color from all four sheets of the donor materials 36 have been transferred and the donor sheet materials 36 have been removed from vacuum imaging drum 300, the thermal print media 32 is removed from vacuum imaging drum 300 and transported via a transport mechanism 80 to a colorant binding assembly 180. A media entrance door 182 of colorant binding assembly 180 is opened allowing the thermal print media 32 to enter colorant binding assembly 180, and shuts once the thermal print media 32 comes to rest in colorant binding assembly 180. Colorant binding assembly 180 processes the thermal print media 32 for further binding the transferred colors on the thermal print media 32 and for sealing microbeads on the thermal print media. After the color binding process has been completed, media exit door 184 is opened and the thermal print media 32 with the intended image thereon passes out of colorant binding assembly 180 and image processor housing 12 and comes to rest against media stop 20.

Figure 2:
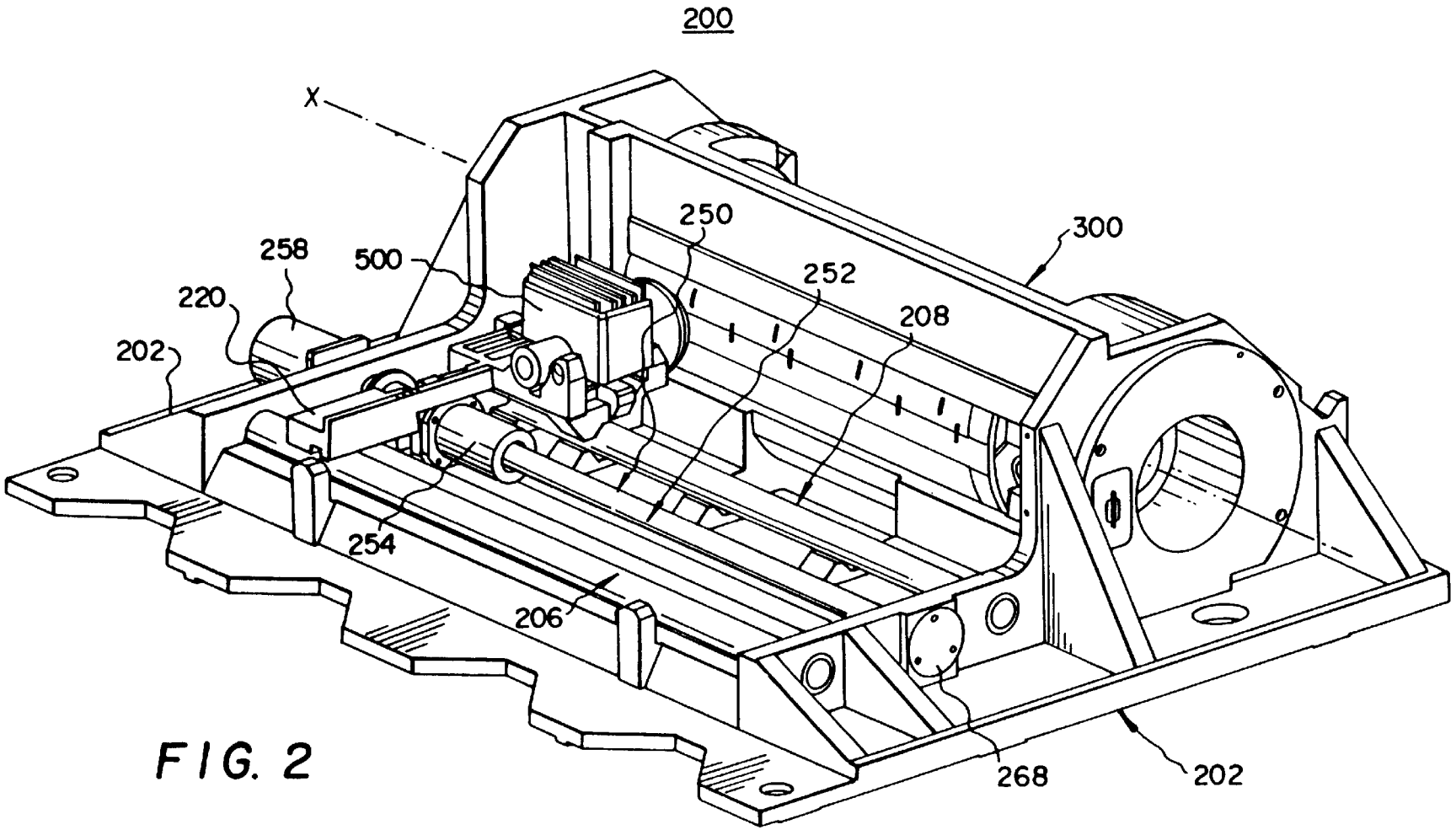
FIG. 2 is a perspective view of the lathe-bed scanning subsystem or write engine of the present invention, as viewed from the rear of the image processing apparatus.

Referring to FIG. 2, show a perspective view of lathe bed scanning subsystem 200 of image processing apparatus 10, including vacuum imaging drum 300, printhead 500 and lead screw 250 assembled in lathe bed scanning frame 202. Printhead 500 is attached to a lead screw 250 via a lead screw drive nut 254 and a drive coupling (not shown) for moving the printhead along the longitudinal axis of vacuum imaging drum 300 for transferring the data to create the intended image onto the thermal print media 32.

Vacuum imaging drum 300 is mounted for rotation about an axis X in lathe bed scanning frame 202. Printhead 500 is movable with respect to vacuum imaging drum 300, and is arranged to direct a beam of light to the donor sheet material 36. The beam of light from printhead 500 for each laser diode 402 (not shown in FIG. 2) is modulated individually by modulated electronic signals from image processing apparatus 10, which are representative of the shape and color of the original image, so that the color on the donor sheet material 36 is heated to cause volatilization only in those areas in which its presence is required on the thermal print media 32 to reconstruct the shape and color of the original image.

Printhead 500 is mounted on a movable translation stage member 220 which, in turn, is supported for low friction slidable movement on translation bearing rods 206 and 208. Translation bearing rods 206 and 208 are sufficiently rigid so as not to sag or distort as is possible between their mounting points and are arranged to be as parallel as possible with axis X of vacuum imaging drum 300 with the axis of printhead 500 perpendicular to the axis X of vacuum imaging drum 300. Front translation bearing rod 208 locates translation stage member 220 in the vertical and the horizontal directions with respect to axis X of vacuum imaging drum 300. Rear translation bearing rod 206 locates translation stage member 220 only with respect to rotation of translation stage member 220 about front translation bearing rod 208 so that there is no over-constraint condition of translation stage member 220 which might cause it to bind, chatter, or otherwise impart undesirable vibration or jitters to printhead 500 during the generation of an intended image.

Printhead 500 travels in a path along vacuum imaging drum 300, while being moved at a speed synchronous with the vacuum imaging drum 300 rotation and proportional to the width of a writing swath 450, not shown. The pattern that printhead 500 transfers to the thermal print media 32 along vacuum imaging drum 300 is a helix.

Head Focus Apparatus

Figure 3:
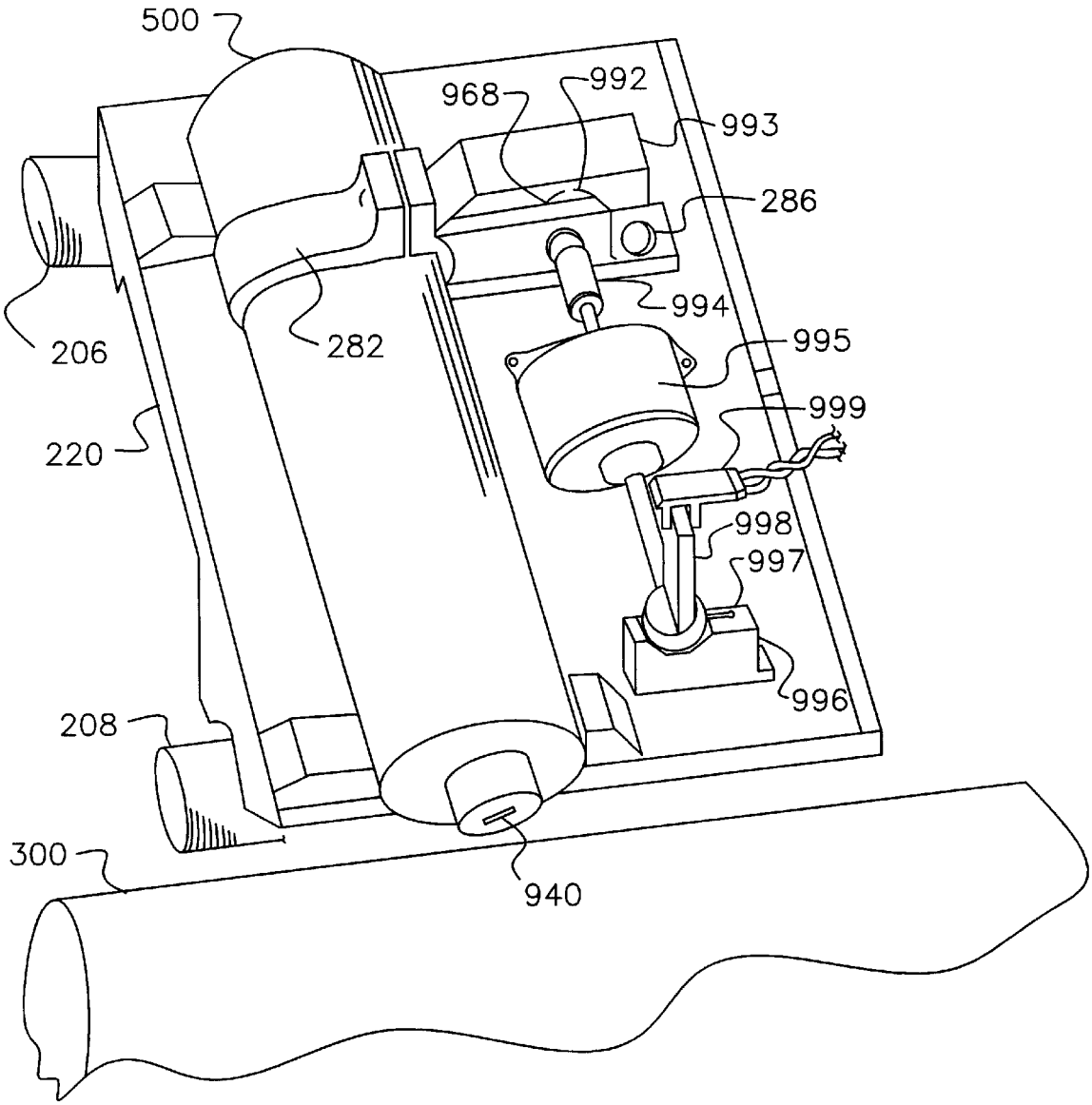
FIG. 3 shows a perspective view of the printhead and support components used to obtain a home position for focus.

FIG. 3 shows a perspective view of printhead 500 and the support components used for focusing the printhead. For clarity, FIG. 3 does not show mounting blocks or brackets whose passive function is simply to hold motor or sensor components in the correct position. A number of such mounting variations is possible, as will be readily apparent to those skilled in the art. FIG. 3 exaggerates the length of the motor shaft, to allow visibility of essential components for this apparatus.

Printhead 500 is fitted snugly within an adjustment collar 282. Focus adjustment are made by applying force to a vertical wing 968 of adjustment collar 282. FIGS. 7*a* and 7*a* shows a front and top views of adjustment collar 282. A stationary mounting block 993 acts as a focus mechanical stop. The preferred embodiment uses magnetic repulsion, applied via a mounting block magnet 992, shown in phantom in FIG. 3, to provide a backloading or spring effect between vertical wing 968 of adjustment collar 282 and stationary mounting block 993.

A focus stepper motor 995, mounted against a mounting block (not shown) on translation stage member 220, provides the linear movement needed for printhead 500 focus position. An important characteristic of the stepper motor is the relationship of the driving phase currents that cooperate to rotate the motor. The phase state relationship of currents that drive the stepper motor which energize different windings in the stator at each successive phase state, gives the rotor shaft only a finite number of possible angular positions. It is this capability that allows the stepper motor to run "open-loop," that is, without encoder feedback, to achieve a precisely known angular position when driven using a precise number of steps. Once a fixed reference home position is established, the stepper motor provides a precise rotation, which can then be mechanically translated to provide precise linear movement, using techniques well-known in the art.

In the preferred embodiment, focus stepper motor 995 acts as a linear actuator, effecting linear movement by incrementing its shaft forward or backwards with each motor step. The preferred embodiment uses a model no. 36147-12 Linear Actuator manufactured by Haydon Switch and Instrument, Inc., Waterbury, Conn. This device provides .000125 in. (3.175 micron) linear movement per motor step. To provide this motion, an internal plastic rotor (not shown) in focus stepper motor 995 rotates at 3.75 degrees per step.

A spherical shaft button 994, fastened to the drive end of the shaft of focus stepper motor 995, attracts a collar focus magnet 286, causing the drive end of the shaft of focus stepper motor 995 to maintain contact with adjustment collar 282. Collar focus magnet 286 presents a repulsive force to a mounting block magnet 992, which provides backloading against adjustment collar 282 for accurate positioning.

As shown in FIG. 3, printhead 500 is mounted in place on translation stage member 220 and is moved backward and forward by the action of focus stepper motor 995. In the preferred embodiment, the cylindrical body of printhead 500 is held against translation stage member 220 by magnetic attraction, where the magnets themselves are provided with bearing surfaces to allow sliding movement across the magnet face. Alternate methods may be employed to allow controlled movement of printhead 500 for focus, for example, mechanical spring loading.

The motor torque of focus stepper motor 995 is sized proportionately to overcome the backloading force from mounting block magnet 992 which opposes movement, so that the rear surface of vertical wing 968 of adjustment collar 282 touches the front surface of a stationary mounting block 993 to provide a mechanical stop.

A focus home flag 998 is configured as a linear position indicator, traveling at the end of the shaft of focus stepper motor 995. As focus stepper motor 995 backs adjustment collar 282 toward stationary mounting block 993, focus home flag 998 interrupts the emitted light signal in a focus home sensor 999. Focus home sensor 999 is a standard optical sensor, in the preferred embodiment, type 1A05HR, manufactured by Sharp Electronics Corporation. Focus home sensor has a conventional emitter-receiver leg configuration well-known in the art. The mounted position of focus home sensor 999 allows clear passage of focus home flag 998 through its emitter-receiver legs as the shaft of focus stepper motor 995 moves linearly.

A travel block 996 and a rotary constraint member 997 cooperate to prevent focus home flag 998 from rotating along with the motor shaft. This keeps focus home flag 998 in a vertical orientation as the motor shaft turns.

In alternate embodiments, an electrical contact or mechanical switch at or near the end of the travel path are used to indicate arrival of printhead 500 at a mechanical stop position for focus homing. This arrangement eliminates the need for focus home sensor 999 and for focus home flag 998 and its mechanical support components.

Angular Adjustment Apparatus

In the preferred embodiment, head angle adjustment is made using the same type stepper motor type, photoelectronic sensor type, indicator flag type, and overall support hardware that is used for head focus positioning and homing described above.

Figure 4:
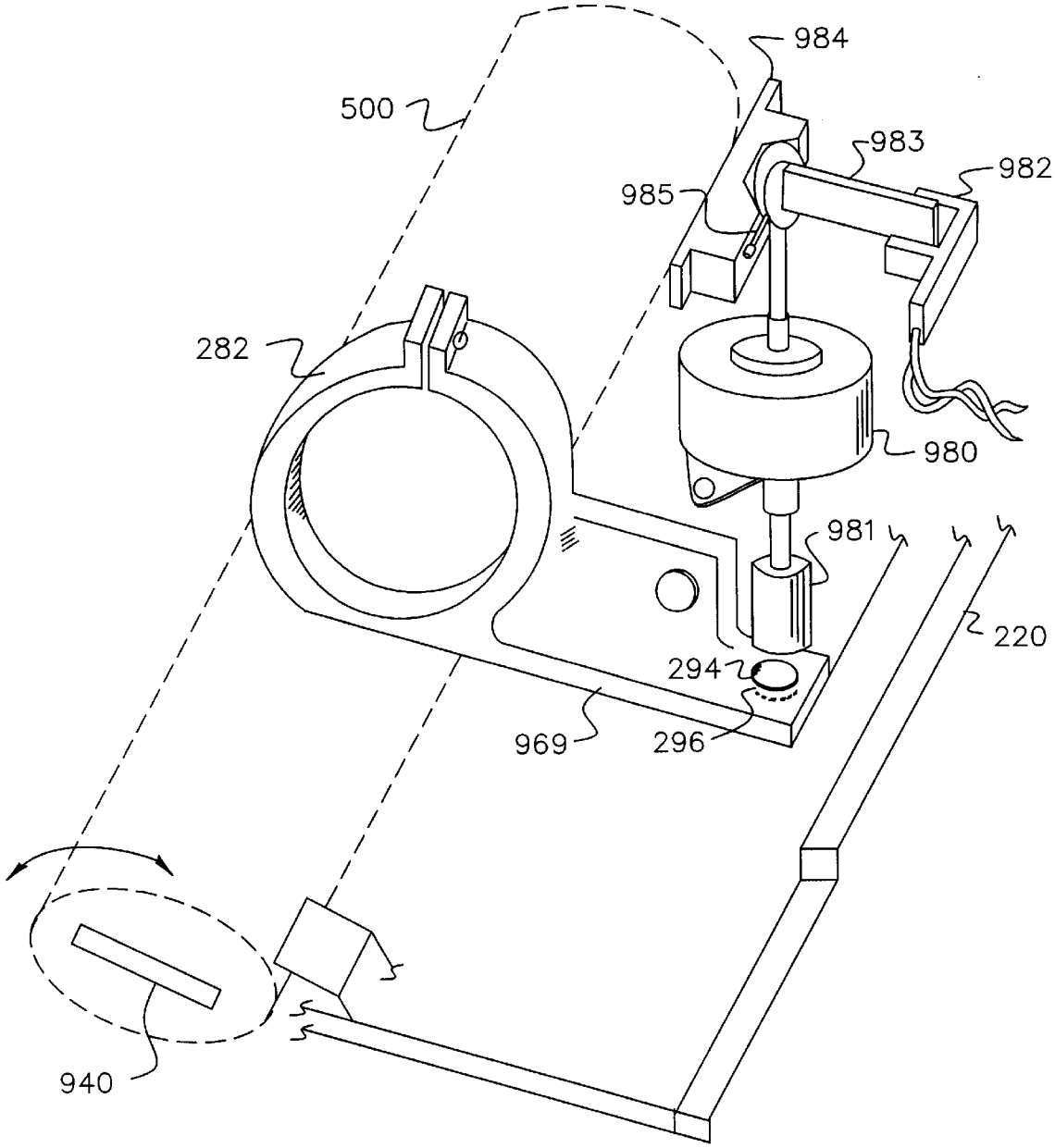
FIG. 4 shows a perspective view of support components used to obtain a home position for printhead angle adjustment.

FIG. 4 shows a perspective view of printhead 500 and the support components used for obtaining angular rotational adjustment For clarity, FIG. 4 does not show mounting blocks or brackets whose passive function is simply to support motor or sensor components in the correct position. A number of various arrangements is possible, as will be readily apparent to those versed in the art. FIG. 4 deliberately exaggerates the length of the motor shaft, to allow visibility of essential components for this apparatus.

Printhead 500 is fitted snugly within adjustment collar 282 during manufacture. To coarsely position the head angle, a set screw (not shown) at the side of the collar mates with a corresponding threaded hole (not shown) on the printhead 500 assembly. Adjustment of printhead 500 angle is accomplished by applying force in a downward vertical direction against a horizontal wing 969 of adjustment collar 282. The preferred embodiment uses magnetic repulsion, via a translation stage member head angle magnet 296, represented in phantom in FIG. 4, to provide a backloading or spring effect between a horizontal wing 969 of adjustment collar 282 and translation stage member 220.

An angle adjust stepper motor 980, mounted against a stationary mounting block (not shown) on translation stage member 220, provides the linear movement needed for printhead 500 angular adjustment. Angle adjust stepper motor 980 acts as a linear actuator, operating in similar manner to the head focus positioning described above. A spherical shaft button 981, fastened at the drive end of angle adjust stepper motor 980, attracts collar head angle magnet 294. Translation stage member head angle magnet 296 provides repulsive polarity to collar head angle magnet 294, which provides backloading for accurate angular positioning.

The same mounting arrangement for printhead 500 on translation stage member 220, described above for head focus home position, also facilitates head angle adjustment which allows printhead 500 to be rotated. The motor torque of angle adjust stepper motor 980 is sized proportionately to be able to overcome the mass of printhead 500 and the backloading force of opposed magnets. Translation stage member 220 provides a mechanical stop to oppose further downward movement of adjustment collar 282.

An angle adjust home flag 983 is configured as a linear position indicator, traveling at the end of the shaft of angle adjust stepper motor 980. As angle adjust stepper motor 980 forces adjustment collar 282 downward toward the surface of translation stage member 220, angle adjust home flag 983 interrupts the emitted light signal in an angle adjust home sensor 982. Angle adjust home sensor 982 is of the same type and overall arrangement used for focus homing, as described above. The mounted position of angle adjust home sensor 982 allows clear passage of angle adjust home flag 983 through its emitter-receiver legs as the shaft of angle adjust stepper motor 980 moves linearly.

An angle adjust travel block 984 and a rotary constraint member 985 cooperate to prevent angle adjust home flag 983 from rotating at the end of the motor shaft. This keeps angle adjust home flag 983 moving along the same vertical plane as the motor shaft turns.

In an alternate embodiment, an electrical contact or mechanical switch at or near the end of the travel path could be used to indicate arrival of printhead 500 at a mechanical stop position for angular rotation homing. This arrangement would eliminate the need for angle adjust home sensor 982 and for angle adjust home flag 983 and its mechanical support components.

Homing Procedure for Printhead Focus

Figure 5:
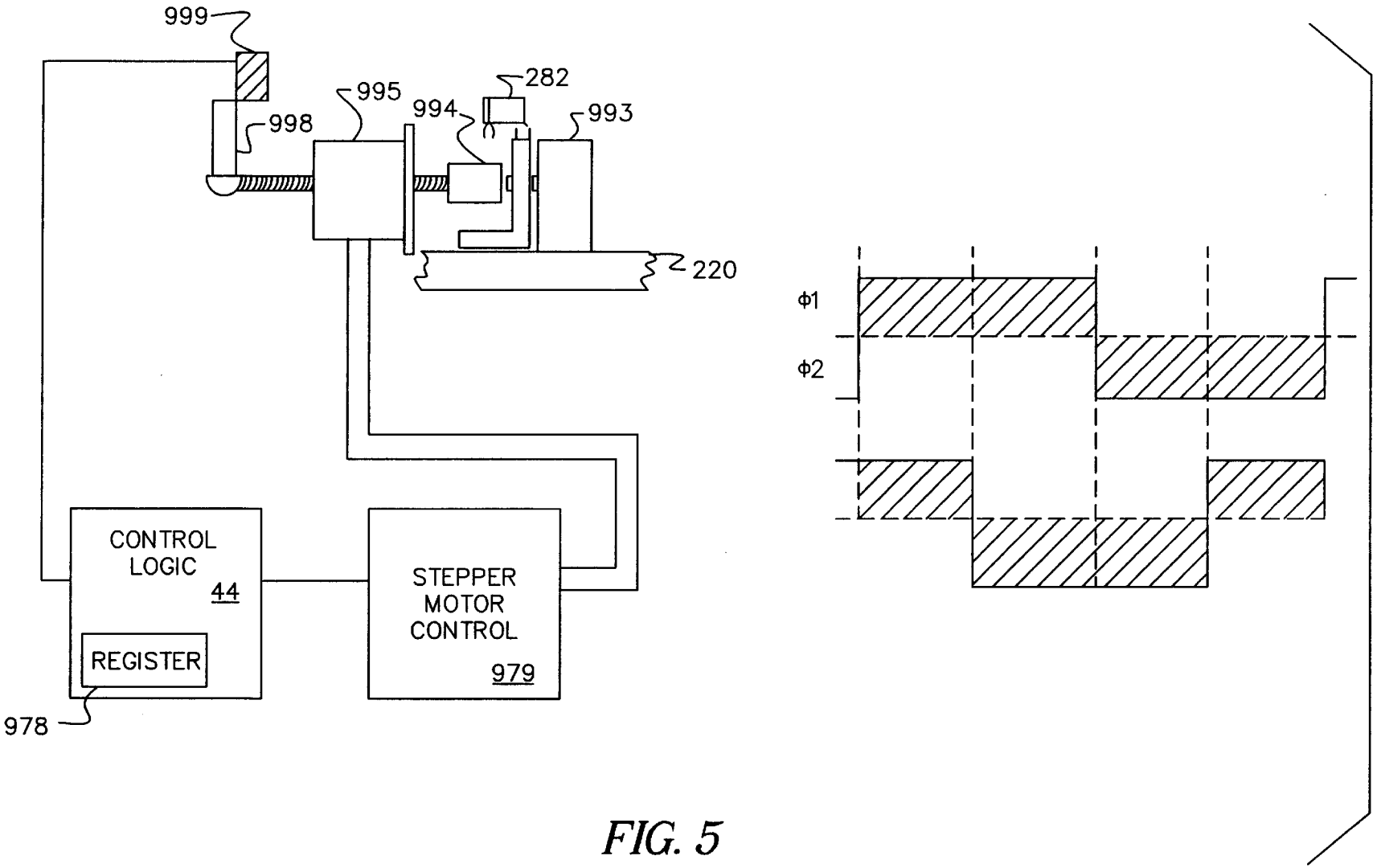
FIG. 5 gives a block diagram of the stepper motor control loop for focus positioning.

FIG. 5 is a block diagram of the control loop used for printhead focus position. A control logic processor 44 is a conventional circuit, typically microprocessor-based, that is familiar in the art of motion control. Control logic processor 44 operates based on an internally stored program and includes a read-write memory register 978. A stepper motor control 979 is a conventional driver unit for stepper motors, such as the IM483 Controller from Intelligent Motion Systems, Inc., Taftville, Conn. Sample phase 1 and phase 2 waveforms shown in FIG. 5 represent the states of stepper motor driver current, or phase states. There are four phase states for a four-step stepper motor control sequence, as used in the preferred embodiment, where each change in phase state advances rotor position one full step.

In FIG. 6 shows a block diagram of the procedure for homing printhead 500 for focus. In step 810 stepper motor control 979 drives focus stepper motor 995 in reverse direction to move the shaft backwards. To the right as represented in FIG. 5 to home printhead 500. In the preferred embodiment, stepper motor control 979 drives printhead 500 at 100 steps per second or pulses per second (PPS). As was described above, this urges adjustment collar 282 toward stationary mounting block 993, which provides backloading force. At a predetermined linear position before the mechanical stop linear position, focus home sensor 999 changes to an active (blocked) state, step 812, due to detection of the edge of focus home flag 998, which moves with the end of the shaft of focus stepper motor 995. When focus home sensor 999 changes to an active state, stepper motor control 979 stops pulsing, step 814, focus stepper motor 995, which stops the motor. Then, stepper motor control 979 provides motor pulses in the forward direction, step 816, at a slower rate, 33 pulses per second, in the preferred embodiment. After each pulse, focus home sensor 999 is checked for an inactive (unblocked) state, step 818. As soon as focus home sensor 999 goes inactive, control logic processor 44 resets stepper motor controller 979 to a known state, step 820. Each time it is activated, reset 820 sets the output currents at stepper motor controller 979 to the same known state, that is, to the same one of the four possible current phase relationships. The reset action typically puts both current levels in an on or "1" state or in an off or "0" state. Focus home is thereby achieved.

It can be appreciated that repeatability is most important for focus positioning. That is, once a reference point is established along the linear travel path of printhead 500 focus, it is necessary that the homing apparatus be able to "home" to this exact reference point at the start of any subsequent focusing sequence. By resetting to the same known state at the point where focus home sensor 999 is sensed, control logic processor 44 thereby establishes a reference position that is repeatable.

Subsequent moves made from this reference position are made in multiples of 4 steps, so that the motor phase following a move is in the same phase as the motor phase at reset. This behavior maintains accuracy with respect to the reference position for all subsequent moves. In addition, by maintaining this phase relationship, control logic processor 44 maintains positional repeatability should power to the apparatus be lost and restored. When power is restored, an automatic reset action by stepper motor controller 979 restores the same phase state, thereby maintaining printhead 500 in the correct position.

From this precise reference position, control logic processor 44 can then move printhead 500 forward a predetermined number of steps (a multiple of 4) from the stopped position to a reference position used for achieving printhead 500 focus. Significantly, control logic processor 44 can repeat the homing cycle just described whenever necessary to re-focus printhead 500 and locate the exact linear position of printhead 500 each time.

It should be noted that resetting the phase state allows control logic processor 44 to begin focus stepper motor 995 movement precisely at the very next step in the reverse direction so that no step is skipped and precise repeatability can be effected.

As FIG. 6 shows, error handling is also provided by control logic processor 44, using timeouts or other standard methods well-known in the art, to indicate the failure of focus homing to occur within the expected time.

Alternative Homing Procedure for Printhead Focus Using Mechanical Stop

An alternative focus home method uses the combination of phase state relationships and the ability of the stepper motor to run with its rotor blocked, as is mentioned above. For this alternative method, focus homing again begins with control logic processor 44 backing printhead 500 toward focus home sensor 999. Once focus home sensor 999 changes state, stepper motor control 979, under the command of control logic processor 44, continues to drive focus stepper motor 995 backwards for a predetermined number of additional steps that is calculated to be more steps than is necessary to reach the mechanical stop position. This assures that adjustment collar 282 is wedged against stationary mounting block 993 as focus stepper motor 995 continues to rotate its shaft for at least four additional steps. For example, control logic processor 44 could cause focus stepper motor 995 to rotate at least 40 steps beyond the mechanical stop. This value is nominal and could be variable from machine to machine, as the precise number of steps beyond mechanical stop position is not critical, provided it is not excessive.

After driving focus stepper motor 995 backwards by a predetermined, programmed value, control logic processor 44 stops stepper motor 995. Control logic processor 44 stores, in register 978, the value of the last phase state provided to stepper motor 995. This provides an index for subsequent movement of focus stepper motor 995.

FIG. 8 shows how the phase 1-phase 2 stepper motor drive currents cause the stepper motor to rotate its rotor and thereby advance its shaft in a linear direction. The four stepper motor phase states are as represented here. The description that follows references components shown in FIG. 3 used for focus homing of printhead 500, however the same principles apply for angular homing of printhead 500, with the substitution of the corresponding components shown in FIG. 4.

FIG. 8 illustrates four positions of a rotor 955 relative to a stator 956. In actual practice, rotor 955 moves in much smaller angular increments than is represented in FIG. 8. As noted earlier, the preferred embodiment uses a stepper motor that gives 3.75 degrees per step. For the purpose of illustrating the key underlying concept employed in the present invention, FIG. 8 shows only four discrete rotor 955 positions. In actual practice, a stepper motor controller loops repeatedly, to repeat the four phase 1/phase 2 states in the sequence shown so as to rotate rotor 955 over its full angular travel path.

The four phase 1/phase 2 phase state relationships shown generally as a loop 957 in FIG. 8 represent the four alternating states of current flow direction: forward current (similar to logic "1") or reversed current (similar to logic "0"), through windings in stator 956. For the purpose of illustration, the two phase 1 windings are disposed horizontally within stator 956; the two phase 2 windings are disposed vertically.

The four phase states are numbered, 1–4 respectively, above each highlighted phase position in FIG. 8. For a position 950, phase 1 and phase 2 currents have the same forward (or logic "1") state and move rotor 955 to the position shown. For a position 951, phase 2 current changes to a reversed (logic "0") state, reversing the current flow for the two phase 2 windings and causing rotor 955 position to shift one step as indicated. For a position 952, phase 1 current then changes direction, effecting another step change in rotor 955 position. For a position 953, phase 2 current changes direction, causing another step increment.

For the next step position beyond that shown at position 953, stepper motor control circuitry switches phase 1/phase 2 currents so as to loop back to the initial phase state relationship (indicated as step 1 for position 950) with both current phases again in a forward (logic "1") state. Ordinarily, this would move rotor 955 an additional step increment (clockwise as shown) to the next position (that is, 3.75 degrees ahead of its orientation at position 953). However, if rotor 955 is blocked, as indicated by the dotted line as rotor-blocked position 954, further clockwise movement is impossible. Thus, position 953 shows the furthest clockwise advance that is possible for rotor 955.

Because rotor 955 position is determined by the magnetic states of stator 956 windings, the rotor cannot maintain its position 953 orientation when phase 1-phase 2 currents loop back to the phase states they held when at position 950. Instead, rotor 955, responding to the change in magnetic attraction from stator 956 windings, moves three steps counterclockwise, back to position 950. At the very next phase state change, rotor 955 then takes the orientation it had at position 951. A further phase state change moves rotor 955 to its orientation at position 952. Again, a further step moves rotor 955 to its orientation at position 953. And again, a further step moves rotor 955 backwards, to its position at orientation at position 950.

Once the motion of the stepper motor is blocked, repeated cycling through the four phases shown in FIG. 8 causes rotor 955 to repeat the action just described, continuously moving between positions 950–953 (with noticeable "chatter" if steps repeat at a high enough speed). The stepper motor is designed to withstand some amount of mechanical strain from such repeated activity; however, if this action were to repeat for an excessive number of cycles, internal components of the motor could be damaged. This is particularly true for motors such as that used in the preferred embodiment, where the internal rotor is a plastic nut that revolves about the shaft, with the shaft angle held stationary to prevent its rotation, to effect linear movement.

To reduce the possibility of damage to focus stepper motor 995 components, the alternative method uses the sensing mechanism provided by focus home sensor 999 cooperating with focus home flag 998. Once focus home sensor 999 changes state, focus stepper motor 995 is known to be near its end of travel. From this point, control logic processor 44 then limits the number of steps delivered to focus stepper motor 995, to limit the number of times the stepper motor is required to repeat the movement indicated by positions 950–953.

By storing the last programmed phase state delivered to focus stepper motor 995 with rotor 955 blocked, control logic processor 44 establishes a reference position that is repeatable. Referring to the example of FIG. 8, the reference position would be one of positions 950–953, as determined by the last phase state used.

From this precise reference position, control logic processor 44 can then move printhead 500 forward a predetermined number of steps (away from the mechanical stop position) to a reference position used for achieving printhead 500 focus. Significantly, control logic processor 44 can repeat the homing cycle just described whenever necessary to re-focus printhead 500 and locate the exact linear position of printhead 500 each time.

Homing Procedure for Head Angular Adjustment

Adjustment of the angle of printhead 500 is implemented in a similar fashion to the focus homing method of the preferred embodiment, described above, with the same overall logic. The control loop shown for focus homing in FIG. 5 is also employed for control of the motor used for setting the printhead angle. Again, control logic processor 44 drives stepper motor control 979 to provide rotary motion that is translated to linear motion by an angle adjust stepper motor 980. An angle adjust home flag 983 cooperates with an angle adjust home sensor 982 to provide feedback to control logic processor 44, again in the form of a sensor transition.

It can be readily appreciated that the logic shown in FIG. 6 also provides an algorithm for homing the head angle. Stepper motor control 979 drives angle adjust stepper motor 980 to apply downward movement to adjustment collar 282 (in the preferred embodiment, the rate is 100 steps per second). Opposed magnets, as described above, provide a backloading force against this downward movement. At a predetermined angular position (before the mechanical stop of adjustment collar 282 at contact with the surface of translation stage member 220), angle adjust home sensor 982 changes to an active (blocked) state, due to detection of the edge of angle adjust home flag 983, which is moving with the end of the shaft of angle adjust stepper motor 980. When angle adjust home sensor 982 goes active, stepper motor control 979 stops pulsing angle adjust stepper motor 980, which stops the motor. Then, stepper motor control 979 provides motor pulses in the opposite direction, at a slower rate (in the preferred embodiment, this slower rate is 33 steps per second). After each pulse, angle adjust home sensor 982 is checked for an inactive (unblocked) state. As soon as angle adjust home sensor 982 goes inactive, control logic processor 44 resets stepper motor controller 979 to a known state. Homing of the printhead 500 angle is thereby achieved.

From this precise reference position, control logic processor 44 can then move printhead 500 clockwise or counter-clockwise a predetermined (multiple of 4) number of steps to a reference position used for obtaining the desired printhead 500 angle adjustment. Significantly, control logic processor 44 can repeat the homing cycle just described whenever necessary to re-home the angle of printhead 500. Each homing operation brings printhead 500 to the same reference point.

Alternative Homing Procedure for Printhead Angle using Mechanical Stop

An alternative printhead 500 angle homing method uses the combination of stepper motor phase state relationships and the ability of the stepper motor to run with its rotor blocked, as is mentioned above. For this alternative homing method, angle adjust stepper motor 980 moves adjustment collar 282 downward toward the surface of translation stage member 220. The transition of angle adjust home sensor 982 is used to indicate proximity of adjustment collar 282 to its mechanical stop position. Once this transition is detected, angle adjust stepper motor 980 is pulsed a predetermined number of additional times, so that adjustment collar 282 is at the mechanical stop. The phase relationships shown in FIG. 8 apply for angle adjust stepper motor 980 as it reaches a mechanical stop position.

In parallel fashion to the alternate embodiment for focus homing described above, control logic processor 44 stores the last stepper motor phase state delivered to angle adjust stepper motor 980 once it is known to be blocked, and uses this stored phase state as the reference for further adjusting printhead 500 angle to a suitable home position.

As with focus homing described above, the head angle homing sequence is repeatable, allowing control logic processor 44 to reach the same angular reference position every time the corresponding control cycle for angular homing executes.

Adjustment for Focus

Once a reference home position for focus has been achieved, using one of the methods described above, the focus adjustment for imaging can be made.

For the preferred embodiment, focus adjustment procedure begins with an attempt to find a coarse focus position. After the best coarse position is identified, fine focus adjustments can be obtained from this point.

To obtain the best coarse position, the following sequence is repeated as many times as is necessary:

1. Advance printhead 500 to the home position. Control logic processor 44 moves stepper motor control 979 forward from the home position a predetermined number of steps. For repeatability, this number of steps must be a multiple of 4. (For example, one embodiment may use 52 steps for the first move. Subsequent moves then might use 4, 8, or 12 steps, as determined by the coarse focus requirements.)
2. Print a sequence of test patches at each coarse-positive step. The best test patch sequence for a determination of coarse focus is a sequence of solid patches, imaged at a relatively high laser power level to provide relatively high density levels when a position near focus is achieved.

Steps 1 and 2 are repeated a number of times, until the best coarse focus position is determined, based on density measurement. The highest density readings will be obtained where the best coarse focus position has been reached.

Because the focus position of printhead 500 can be changed by control logic processor 44, the series of solid patches for a number of successive coarse focus positions can be printed in sequence on a single output sheet. Thus, for example, the image processing apparatus can print the patches for printhead 500 position at step motor position 52, then move printhead 500 forward and print patches for step motor position 60, then move printhead 500 forward again and print patches for step motor position 68, etc. Continuing in this manner, a single output sheet will contain patches printed at a number of coarse focus positions. This is particularly advantageous where it is difficult to measure density directly from the output media itself and further processing, such as transfer of the image from an intermediate media to paper, is required before measurements can be made.

Control logic processor 44 stores the coarse focus position in memory register 978. When subsequent focusing operations are necessary, the coarse focus position obtained using the above procedure can be used as a starting point.

Fine-tuning follows a similar pattern, with correspondingly smaller increments of movement and more precise imaging for visual feedback. To obtain fine-focus position, the following sequence is repeated as many times as is necessary:

1. Advance printhead 500 to the coarse position determined above. Control logic processor 44 moves stepper motor control 979 to move printhead 500 forward from its coarse position a predetermined small number of steps that is a multiple of 4. 4 steps are used for this increment in the preferred embodiment.
2. Print a sequence of test patches at each five positions step. The best test patch sequence for a determination of fine focus uses a series of patterns designed to characterize the performance of printhead 500 optics.

Test patches for fine focus assessment may include the following patterns:

Patches having alternate channels on and off.

Patches using some combination of lines on and off, in repeating patterns.

Patches containing solids. Highest density readings are obtained where optimum focus is achieved.

A suitable test print for fine-focus assessment may include any or all of the above patterns, as empirically determined to best suit the requirements of the image processing system.

Control logic processor 44 stores the fine focus positions. These positions can be entered by an operator using a computer interface (not shown) that controls processing operations of the image processing apparatus. By storing the focus positions obtained, control logic processor 44 allows the image processing apparatus to be restored to focus following a power-down condition.

Adjustment for Head Angle

Once a reference home position for head angle has been achieved, using one of the methods described above, and once a five focus position has been achieved, the head angle adjustment for imaging can be made.

FIG. 9 illustrates schematically how the head angle of printhead 500 determines pixel-to-pixel distance and swath width. In FIG. 9, the direction of vacuum imaging drum 300 rotation is indicated by arrow B. The direction of translator motion of printhead 500 parallel to the drum 300 axis is indicated by arrow C. Within printhead 500, a laser array, generally indicated as 940 in FIG. 9, is a grouping of laser channels in a line, typically assembled on a wafer, as is known in the art. Relative to the horizontal pattern of imaged pixels. 944 that appear on the media, laser array 940 is tilted at an angle. Demagnification by a lens 942 reduces the distance between pixels from a fiber-to-fiber distance 946 within printhead 500, nominally 130 microns, to a lesser value 946', nominally 59 microns. Delaying the energization of each fiber slightly prints imaged pixels 944 on thermal print media 32 in a line that is one swath-width wide, with the desired pixel-to-pixel distance 948 (nominally 10 microns in the preferred embodiment). U.S. Pat. No. 5,258,776 (Guy, et al.) describes the timing method for delaying energization of each fiber so that individual pixels 944 are aligned when printed on thermal media 32.

It can be seen that over the range of movement allowed for adjustment collar 282, the greater the tangent of the angle of incline of laser array 940, relative to horizontal, indicated as a dashed line H in FIG. 9, the smaller the resulting pixel-to-pixel distance 948. In the preferred embodiment, lens 942 provides 2.2:1 demagnification which, when combined with the proper head angle, yield a pixel-to-pixel distance 948 of either 10 microns, for 2540 dpi imaging, or 10.58 microns, for 2400 dpi imaging. In the preferred embodiment, a head angle of approximately 80.3 degrees yields 2540 dpi spacing. A head angle of approximately 79.7 degrees yields 2400 dpi spacing.

To set the angle of printhead 500 for the intended resolution, angle adjust stepper motor 980 forces spherical shaft button 981 against horizontal wing 969 of adjustment collar 282. The pivot point for this rotational movement of adjustment collar 282 is in line with the center axis of printhead 500. Downward movement of spherical shaft button 981 would urge adjustment collar 282 from the position shown to the new position, such as that position indicated at A in FIG. 9, thus changing the angle of laser array 940, which in turn changes pixel-to-pixel distance 948.

Head angle adjustment begins with obtaining an initial coarse position. This requires an initial setting of the printhead 500 angle to the home position, as described above. Then, angle adjust stepper motor 980 advances the angle of printhead 500 to a predetermined start position for coarse adjustment, determined empirically. Following this movement to a start position, coarse adjustment for head angle uses the following sequence, repeated as many times as is necessary:

1. Print a sequence of test patches. The preferred embodiment employs a test patch sequence for determination of head angle that uses a pattern of dots imaged by successively energizing multiple non-adjacent laser channels at a time for short intervals. The resulting pattern of dots then allows measurements to determine whether the head angle requires adjustment.
2. Change printhead 500 angle by moving angle adjust stepper motor 980 a predetermined coarse number of steps, printing test patches at each course-step.

Repeating Steps 1 and 2 a number of times yields one or more test prints that allow a simple visual assessment for determining the best coarse angle adjustment. When coarse angular adjustment increments are properly chosen based on the design, the sequence of test patches generated shows unwritten or white space between adjacent swaths where the angle of printhead 500 is too steep. When the angle is not steep enough and swath overlap results, the test print shows bands at the edge of each swath that have higher densities. Where the angle is reasonably close, the test print shows uniform areas with no visually detectable distance and no detectable "beats" between swaths. The best coarse position for head angle is then a positioned near the middle of this range of settings.

Similar to the process for the focus test print described above, a single head angle test print can be imaged with the printhead 500 set at several different angles over the width of the test print. This is because the angle of printhead 500 can be changed by control logic processor 44 without the requirement to stop the image processing apparatus.

Control logic processor 44 stores the coarse head angle adjustment position in memory register 978. When subsequent angle adjustments are necessary for the same printhead 500, the coarse adjustment position thus obtained can be used as a starting point.

Fine tuning follows a similar pattern with correspondingly smaller increments of movement and more exacting examination of the output print thus generated. To obtain final printhead 500 angle adjustment, the following sequence is repeated as many times as is necessary:

1. Print a sequence of test patches. The preferred embodiment employs a test patch, with a series of patterns that characterize the performance of printhead 500 optics. Test patches for head angle assessment may include the following patterns:

Patches having alternate channels on and off.

Patches using some combination of lines on and off, in repeating patterns.

Patches containing solids.
2. Advance printhead 500 to another angular position. Control logic processor 44, via stepper motor control 979, pulses angle adjust stepper motor 980 a small number of steps, where in the number of steps is a multiple of 4.

The preferred embodiment of this invention uses a test print with sequences of patches in a matrix, where a progressive series of channels is turned off, in a pattern that moves across and down the test print. Table 1 shows how this sequence of patches is generated for the first few rows and columns of the test print. All channels are on, except those noted.

TABLE 1

Illustration of Pattern Used for Head Angle Test Print

| | Column 1 | Column 2 | Column 3 | Column 4 . . . |
|---|---|---|---|---|
| Row 1 | channel 1 off | channel 2 off | channel 3 off | channel 4 off |
| Row 2 | channels 1, 2 off | channels 2, 3 off | channels 3, 4 off | channels 4, 5 off |
| Row 3 . . . | channels 1, 2, 3 off | channels 2, 3, 4 off | channels 3, 4, 5 off | channels 4, 5, 6 off |

An operator can visually assess the test print for the optimum head angle setting by observing any undesirable "beat" pattern that is perceptible on the test print but diminishes significantly near the best setting.

Alternate methods for assessing head angle adjustment accuracy include using a microscope to view and measure the distance between lines printed by the same channel on different swaths. Using this method, the necessary adjustment can be computed and automated using Equations 1, 2, and 3.

Equation 1. Determine the Current Head Angle $$CurrentHeadAngle = \arccos\left(\frac{x}{M}\right)$$

Where:

CurrentHeadAngle is the angle computed based on measurements from the test print.

x is the distance measured on thermal print media 32 between channel 1 and a channel m, where m is less than the number of channels in a fill swath. This is the product of (m−1) times pixel-to-pixel distance 948 in FIG. 9.

M is the distance between channel 1 and channel m through lens 942.

This is the product of (m−1) times Spacing where $$Spacing = \frac{Fiber\text{-}to\text{-}fiberdis\ \tan\ ce946}{LensDemagnification}$$

Spacing is indicated in FIG. 9 by numeral 946'.

LensMagnification is the demagnification factor of lens 942. In the preferred embodiment, this value is 2.2.

Equation 2. Determine the Desired Head Angle $$DesiredHeadAngle = \arccos\left(\frac{L}{Spacing}\right)$$

Where:

DesiredHeadAngle is the angle needed based on measurements from the test print.

L is the desired line-to-line spacing, which varies based on the intended resolution. For 2540 dpi resolution, L=10 microns For 2400 dpi resolution, L=10.58 microns Spacing is computed as was described above for Equation 1.

Equation 3. Estimate Vertical Distance to Move Adjustment Collar 282 dY=R x tan(CurrentHeadAngle—DesiredHeadAngle)

Where:

dY is the vertical distance through which angle adjust stepper motor 980 moves to correct the head angle.

R is the effective radius that is the distance from the contact point where spherical shaft button 981 contacts horizontal wing 969 to the center of rotation of lens 942 projected vertically to the base of adjustment collar 282. (In the preferred embodiment, this distance is nominally 3 in., or 76.2 mm)

CurrentHeadAngle is computed as in Equation 1.

DesiredHeadAngle is computed as in Equation 2.

The estimate computed using Equation 3 can then be used to compute the number of steps needed for head angle adjustment, based on measurements from the test print.

The operator specifies the optimum setting to control logic processor 44, via a calibration program designed to facilitate head angle setting.

It is important to note that the ability to change the head angle automatically between test patches minimizes the need for costly and labor-intensive manual methods. Without such automation, a skilled technician would first use instrumentation and calculation to measure the distance between swaths, then calculate angles, tangents, and cosines, then make fine manual adjustments, for example, using a micrometer, then retest the adjustments using a subsequent test print.

Alternate Embodiments

The invention has been described with reference to the preferred embodiment thereof. However, it will be appreciated that variations and modifications can be effected within the scope of the invention as described above and as defined in the appended claims by a person of ordinary skill in the art without departing from the scope of the invention. For example, the embodiment of motorized focus and angular adjustment disclosed here for a printhead that travels along an imaging drum could also be applied to a scanning device that uses a platen. Different methods of backloading for focus or angular position could also be employed, for example, springs. This invention could also be applied to an apparatus uses different of types of colorant, such as dyes, inks, and pigments.

PARTS LIST

10. Image processing apparatus
12. Image processor housing
14. Image processor door
16. Donor ejection chute
18. Donor waste bin
20. Media stop
30. Roll media
32. Thermal print media
34. Donor roll material
36. Donor sheet material
44. Control logic processor
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray

62. Linear sensor
64. Linear flag element
66. Rotational sensor
68. Rotary home flag
72. Detent
74. Pin
76. Notch
78. Threshold check
80. Transport mechanism
84. Motor controller
98. Master lathe bed scanning engine
100. Media carousel
110. Media drive mechanism
112. Media drive rollers
120. Media knife assembly
122. Media knife blades
180. Colorant binding assembly
182. Media entrance door
184. Media exit door
198. Master Lathe Bed Scanning Engine
200. Lathe bed scanning subsystem
202. Lathe bed scanning frame
204. Entrance passageway
206. Rear translation bearing rod
208. Front translation bearing rod
220. Translation stage member
250. Lead screw
252. Threaded shaft
254. Lead screw drive nut
258. Linear drive motor
260. Axial load magnets
260*a*. Axial load magnet
260*b*. Axial load magnet
262. Circular-shaped boss
264. Ball bearing
266. Circular-shaped insert
268. End cap
270. Hollowed-out center portion
272. Radial bearing
282. Adjustment collar
286. Collar focus magnet
292. Rotational stop
294. Collar head angle magnet
296. Translation stage member head angle magnet
298. Vacuum nozzle
300. Vacuum imaging drum
301. Axis of rotation
302. Vacuum drum housing
400. Laser assembly
402. Laser diodes
404. Fiber optic cables
406. Distribution block
450. Writing swath
500. Printhead
580. Linear homing
582. Translation to writable area
584. Rotary homing
586. Execute homing routine
940. Laser array
942. Lens
944. Imaged pixels
946. Fiber-to-fiber distance
948. Pixel-to-pixel distance
950. Position 1
951. Position 2
952. Position 3
953. Position 4
954. Rotor-blocked position
955. Rotor
956. Stator
957. Loop
968. Vertical wing
969. Horizontal wing
978. Register
979. Stepper motor control
980. Angle adjust stepper motor
981. Shaft-mounted magnet
982. Angle adjust home sensor
983. Angle adjust home flag
984. Angle adjust travel block
985. Rotary constraint member
992. Mounting block magnet
993. Stationary mounting block
994. Spherical shaft button
995. Focus stepper motor
996. Travel block
997. Rotary constraint member
998. Focus home flag
999. Focus home sensor

What is claimed is:

1. A method for adjusting a focus of a multichannel printhead for an imaging processing apparatus comprising the steps of:

establishing a home focus position;

moving said printhead in a first direction a predetermined number of coarse steps;

printing a series of first test patches on a medium at each of said coarse steps;

determining a coarse focus position by checking a coarse density of each of said first test patches and selecting said coarse focus position corresponding to said first test patch having a highest coarse density;

moving said printhead to said coarse focus position;

moving said printhead in a second direction a predetermined number of fine steps;

printing a series of second test patches on said medium at each of said fine steps; and determining a fine focus position by checking a fine density of each of said second test patches and selecting said fine focus position corresponding to said second test patch having a highest fine density.

2. A method as in claim 1, wherein a stepper motor moves said printhead.

3. A method as in claim 1, wherein said fine focus position is stored in a memory.

4. A method as in claim 3, wherein said fine focus position is stored in said memory indexed to characteristics of said medium.

5. A method as in claim 1, wherein an optimum angle of said printhead is determined by:

establishing a home angular position;

moving said printhead in a first rotational direction a predetermined number of coarse rotational steps;

printing a series of third test patches on said medium at each of said coarse rotational steps;

determining a coarse angular position by checking a coarse rotational density of each of said third test patches and selecting said coarse angular position corresponding to a third test patch having a highest coarse rotational density;

moving said printhead to said coarse angular position;

moving said printhead in a second rotational direction a predetermined number of fine rotational steps;

printing a series of fourth test patches on said medium at each of said fine rotational steps; and determining a fine focus angular position by checking a fine rotational density of each of said fourth test patches and selecting said fine angular position corresponding to said fourth test patch having a highest fine rotational density.

6. A method as in claim 5, wherein a stepper motor moves said printhead.

7. A method as in claim 5, wherein said fine angular position is stored in a memory.

8. A method as in claim 7, wherein said fine angular position is stored in said memory indexed to characteristics of said medium.

9. A method for adjusting a focus of a multichannel printhead for an imaging processing apparatus comprising the steps of:

establishing a home focus position;

moving said printhead a p redetermined number of coarse steps;

printing a series of first test patches on a medium at each of said coarse steps;

determining a coarse focus position by checking a coarse density of each of said first test patches and selecting said coarse focus position corresponding to said first test patch having a highest coarse density;

moving said printhead to said coarse focus position;

moving said printhead a predetermined number of fine steps;

printing a series of second test patches on said medium at each of said fine steps; and determining a fine focus position by checking a fine density of each of said second test patches and selecting said fine focus position corresponding to said second test patch having a highest fine density.

10. A method as in claim 9, wherein an optimum angle of said printhead is determined by:

establishing a home angular position;

moving said printhead a predetermined number of coarse rotational steps;

printing a series of third test patches on said medium at each of said coarse rotational steps;

determining a coarse angular position by checking a coarse rotational density of each of said third test patches and selecting said coarse angular position corresponding to a third test patch having a highest coarse rotational density;

moving said printhead to said coarse angular position;

moving said printhead a predetermined number of fine rotational steps;

printing a series of fourth test patches on said medium at each of said fine rotational steps; and determining a fine focus angular position by checking a fine rotational density of each of said fourth test patches and selecting said fine angular position corresponding to said fourth test patch having a highest fine rotational density.

11. A method for adjusting a focus of a multichannel printhead for an imaging processing apparatus comprising the steps of:

establishing a home angular position;

moving said printhead a predetermined number of coarse rotational steps;

printing a series of first test patches on a medium at each of said coarse rotational steps;

determining a coarse angular position by checking a coarse rotational density of each of said first test patches and selecting said coarse angular position corresponding to a first test patch having a highest coarse rotational density;

moving said printhead to said coarse angular position;

moving said printhead a predetermined number of fine rotational steps;

printing a series of second test patches on said medium at each of said fine rotational steps; and determining a fine focus angular position by checking a fine rotational density of each of said second test patches and selecting said fine angular position corresponding to said test patch having a highest fine rotational density.

12. A method for adjusting a focus of a multichannel printhead for an imaging processing apparatus comprising the steps of:

establishing a home angular position;

moving said printhead in a first rotational direction a predetermined number of coarse rotational steps;

printing a series of third test patches on said medium at each of said coarse rotational steps;

determining a coarse angular position by checking a coarse rotational density of each of said third test patches and selecting said coarse angular position corresponding to a third test patch having a highest coarse rotational density;

moving said printhead to said coarse angular position;

moving said printhead in a second rotational direction a predetermined number of fine rotational steps;

printing a series of fourth test patches on said medium at each of said fine rotational steps; and determining a fine focus angular position by checking a fine rotational density of each of said fourth test patches and selecting said fine angular position corresponding to said fourth test patch having a highest fine rotational density.

* * * * *